United States Patent [19]

Schain et al.

[11] 3,966,205

[45] June 29, 1976

[54] TENNIS SERVE PRACTICE DEVICE AND METHOD OF USING SAME

[76] Inventors: David B. Schain, 11124 Arroyo Drive, Rockville, Md. 20852; Morton R. Kagan, 2 Charen Court, Potomac, Md. 20854

[22] Filed: Feb. 20, 1975

[21] Appl. No.: 551,419

[52] U.S. Cl. ..... 273/29 A

[51] Int. Cl.[2] ..... A63B 69/38

[58] Field of Search ..... 273/29 A, 26 A, 181 A, 273/181 F, 181 R, 105 R, 102 R, 102.1 D, 55 B, 127 R, 127 B, 127 C, 127 D, 102 S

[56] References Cited

UNITED STATES PATENTS

| | | | |
|---|---|---|---|
| 1,433,437 | 10/1922 | Watkins | 273/105 R |
| 3,820,787 | 6/1975 | Heinbigner | 273/105 R |

*Primary Examiner*—Richard C. Pinkham
*Assistant Examiner*—T. Brown
*Attorney, Agent, or Firm*—Roylance, Abrams, Berdo & Kaul

[57] ABSTRACT

A tennis serve practice device includes a frame means having four interconnected frame members which define a trapezium-shaped quadrilateral opening. The size and configuration of the opening is adjustable in calculated accordance with the effective serving height of the user so that the device precisely simulates serving conditions on a regulation tennis court. If the ball served by the user passes through the opening, it would have landed fairly in the service court on a regulation tennis court. A net means loosely disposed behind the opening forms a pocket which receives and retains the balls which pass through the opening. By moving or removing one of the frame members, the device is convertible to a low net for tennis or paddle tennis games or to a high net for volleyball, shuttlecock or other games requiring a net type structure.

12 Claims, 8 Drawing Figures

FIG. 1
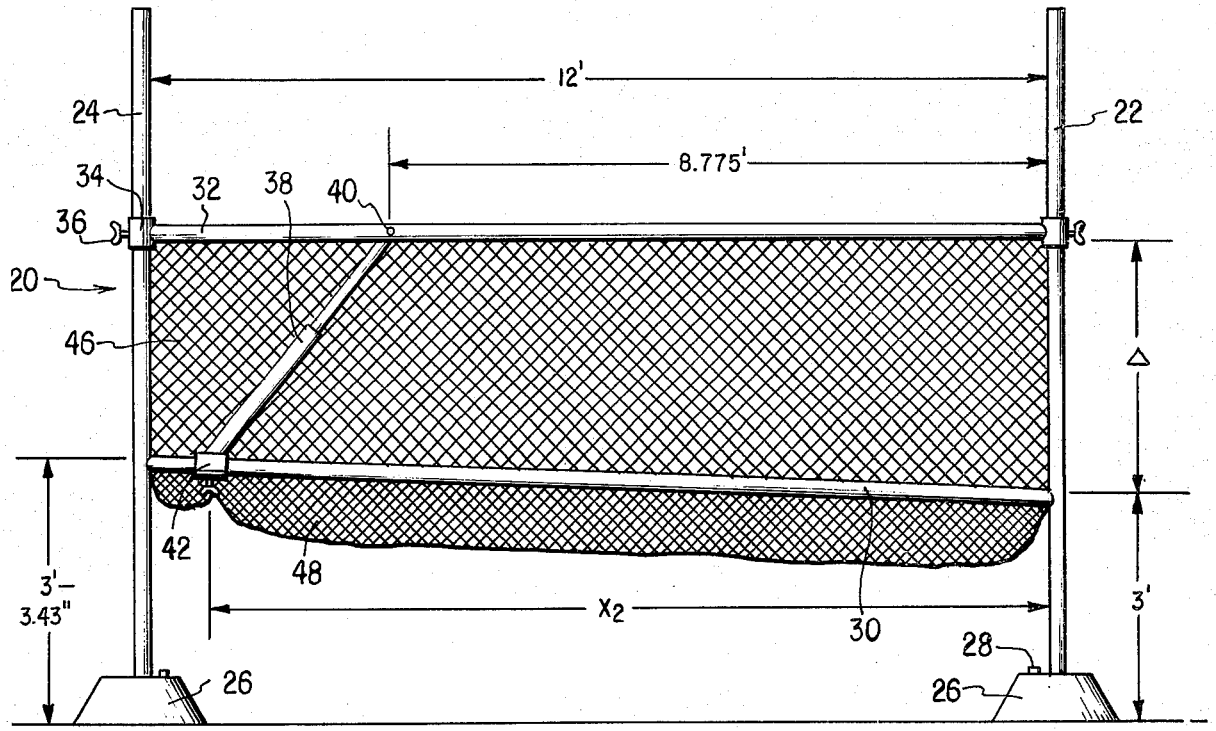
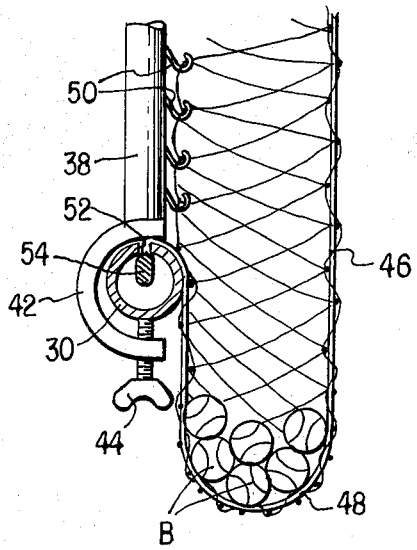
FIG. 2
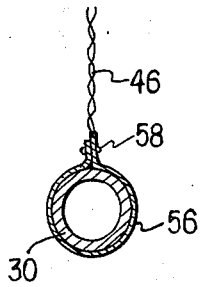
FIG. 3
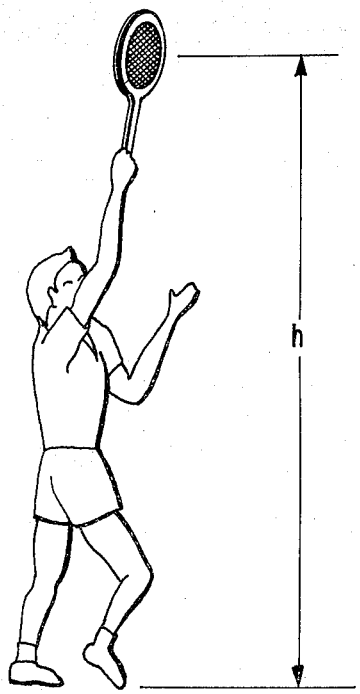
FIG. 4

FIG. 6
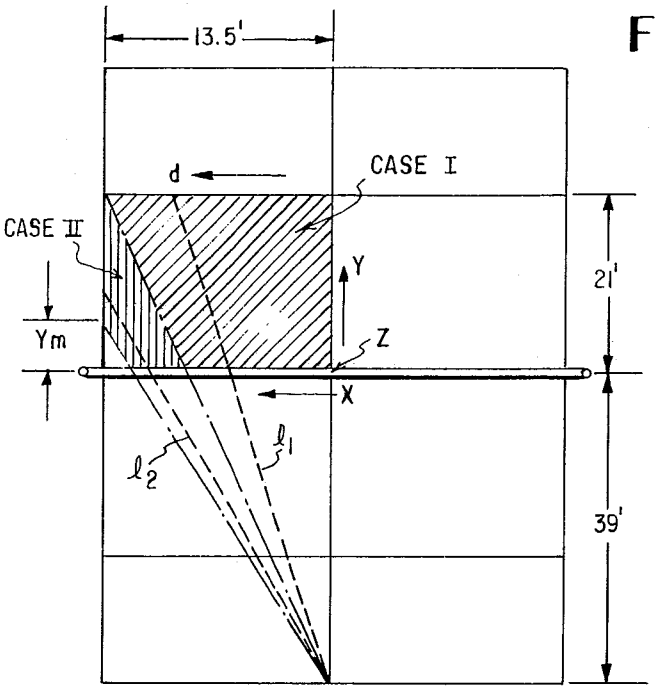
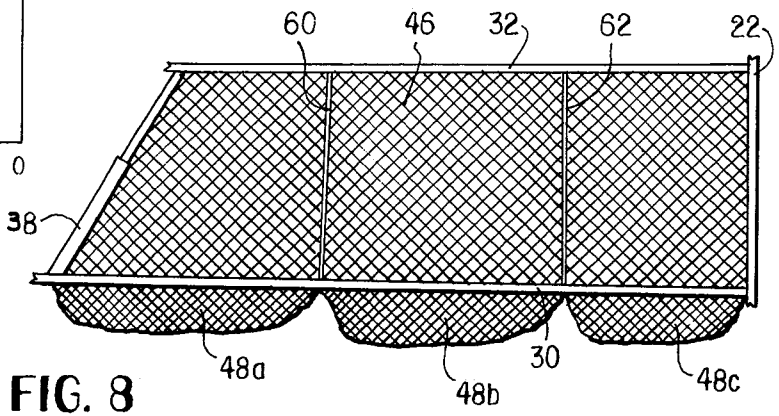
FIG. 8
FIG. 5
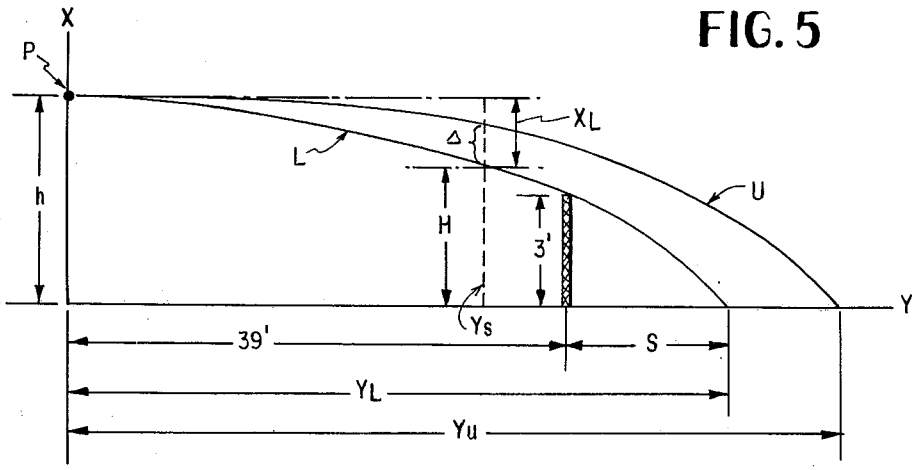
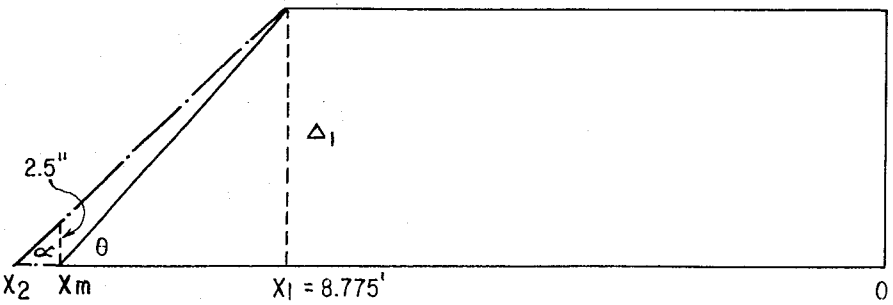
FIG. 7

TENNIS SERVE PRACTICE DEVICE AND METHOD OF USING SAME

This invention relates to a tennis serve practice device and more particularly it relates to a device which can be accurately adjusted to the precise effective serving height of the user to thereby exactly simulate serving conditions on a regulation tennis court.

One of the most important aspects of the game of tennis is the serve, yet the serve is one of the most difficult shots for a player to practice. Ordinarily, the serve must be practiced on a regulation tennis court, but available courts are usually crowded with players thus making it difficult to find an available court for serve practice. Moreover, even if a player does find an available court, it is often difficult to judge whether a particular serve landed inside or outside the service court. Also, the balls which have been served tend to bounce or roll away and the player must spend a significant amount of time in collecting such balls.

Recognizing the foregoing problems, there have heretofore been certain proposals for enabling the individual player to practice his serve at a location other than a tennis court. Typical of such proposals is that shown in U.S. Pat. No. 3,215,432 to Lee et al. This patent, and others of the same type, disclose the use of a target device having an opening therein for receiving and retaining the served balls, and a surrounding portion for rebounding improperly served balls. While such devices are useful, they do not scientifically and accurately define the shape, size and position of the ball opening, and more importantly, they are not variable in accordance with the height of the player. It should be apparent that the path of a serve would vary considerably depending upon whether it was hit by a 4 feet 10 inch child or a 5 feet 5 inch woman or a 6 feet 2 inch man. For each such person, the effective serving height or distance above the ground where the ball impacts with the racket is quite different. If this distance is not considered, and it was not in known forms of devices, then the device could not possibly be accurate for all sizes of players.

Recognizing this fact, it is an object of the present invention to provide a tennis serve practice device which exactly simulates service conditions on a regulation tennis court, regardless of the size of the player.

Another object of the present invention is to provide a tennis serve practice device having a ball receiving and retaining means whose configuration can be adjusted in accordance with the effective serving height of the player.

Another object of the present invention is to provide an accurate adjustable tennis serve practice device which can be used on lawns, driveways or other flat areas, and which can also be used on tennis courts.

Another object of the present invention is to provide a convertible device which can be used for practicing tennis serves and which can be converted to a high net for volleyball or shuttlecock games or to a low net for tennis and paddle tennis games.

Another object of the present invention is to provide a tennis serve practice device which is relatively simple in construction, yet is capable of extended periods of operation without failure and without any unusual maintenance requirements.

Other objects, advantages and salient features of the present invention will become apparent from the following detailed description, which, taken in conjunction with the annexed drawings, discloses a preferred embodiment thereof.

The foregoing objects are attained by providing a frame means consisting of a pair of spaced parallel vertical support posts mounted in ground engaging bases, an upper cross member extending between the posts in parallel relation to the ground, and a lower cross member extending between the posts in non-parallel relation to the ground. The orientation of the lower cross member corresponds exactly to the orientation of the top of a regulation tennis net. The frame means also includes an adjustable member which is variable in length, as, for instance, a pair of telescoping tubes. The upper end of the adjustable member is pivotally connected to the upper cross member at a calculated distance of displacement from the posts. The lower end of the adjustable member is adjustable connected to the lower cross member at a calculated distance of displacement from the posts. The upper cross member is adjustably connected at its ends to the posts and the distance by which the upper cross member is displaced from the lower cross member is a calculated amount.

That portion of the frame means circumscribed by the inner support post, the adjustable member, and the upper and lower cross members defines a trapezium-shaped quadrilateral opening whose configuration can be varied by adjustment of the upper cross member and by adjustment of the adjustable member. All adjustments are made in calculated accordance with the effective serving height of the user and once such adjustments are made, the device will perfectly simulate conditions on a regulation tennis court. That is, the user stands a predetermined distance away from the device and hits serves toward the device. It the served ball passes through the opening, it would constitute a good serve on a regulation tennis court. If the served ball fails to pass through the opening, it would constitute a fault on a regulation tennis court.

Net means are provided in attachment to the frame means for the purpose of retaining balls which are hit through the opening. The surface area of the net behind the opening is greater than the area of the opening, at least in vertical measurement, so that the net actually forms a loose pocket into which balls drop after they are hit through the opening.

The upper cross member can be raised to convert the device into a net suitable for volleyball, badmitton or other shuttlecock games. Similarly, the upper cross member can be dropped beneath the lower cross member to convert the device into a regulation height tennis net.

Referring now to the drawings which form a part of this original disclosure:

FIG. 1 is a front elevational view of a tennis serve practice device in accordance with the principles of the present invention;

FIG. 2 is a fragmentary sectional view showing the adjustable member and the net connected to the lower cross member;

FIG. 3 is a fragmentary sectional view showing an alternative means for connecting the net to the cross members;

FIG. 4 is a diagrammatic view showing the manner of calculating the effective serving height;

FIGS. 5–7 are diagrammatic views used in calculating the adjustment equations for the opening in the device; and FIG. 8 is a front elevational view showing lateral divisions of the pocket behind the opening.

Referring first to FIG. 1, there is illustrated therein a tennis serve practice device in accordance with the present invention, such device being generally designated 20. The device 20 includes a pair of spaced parallel upstanding support posts 22 and 24. The post 22 can be considered the inner post and it is the one that would be aligned with the centerline on a tennis court. Naturally, therefore, the other post 24 can be considered the outer post. Both posts are supported in ground-engaging base members 26 which can be formed as hollow bodies having removable fill caps 28 thereon. When the caps are removed, the base members 26 can be filled with sand or water to increase their weight. Also, the base members can be easily emptied to make them lighter for transport.

A lower cross member or cross bar 30 extends between the posts 22 and 24 and is affixed thereto. The top of the cross member 30 follows precisely the configuration of the top of a regulation tennis net. As such, the point where the cross member 30 connects to the post 22 is exactly three feet above the ground since this corresponds to the midpoint of a regulation net. As the cross member 30 extends outward toward the post 24, it increases slightly in height, just as a regulation tennis net gradually rises to a height of 3½ feet where it connects to its outer support post. As shown in FIG. 1, in the device 20 the posts 22 and 24 are spaced apart by a distance of substantially twelve feet. The reason for this is that such a spacing will accommodate all normal adjustments which would ordinarily be made on the device. Using such a 12 foot spacing, the point where the cross member 30 connects to the post 24 is exactly 3 feet 3.43 inches above the ground. Calculations set forth hereinafter will show how this height is derived.

An upper cross member or cross bar 32 extends between the posts 22 and 24 in parallel relation to the ground. The ends of the cross member 32 fit into collars 34 which are adjustably positioned along the posts 22 and 24 and which are retained in position by wing nuts, set screws 36.

An adjustable member 38 extends angularly between the upper and lower cross members. The adjustable member is necessarily variable in length and advantageously takes the form of a pair of telescoping tubes. The upper end of the adjustable member 38 is pivotally attached at 40 to the upper cross member 32. The location of the pivot 40 is exactly 8.775 feet displaced from the post 22 and calculations will be set forth hereinafter to show how this displacement is figured. An open clamp 42 is provided at the lower end of the adjustable member 38 to permit adjustment along the length of the lower cross member 30. A wing nut, set screw 44, is used to lock the clamp 42 in its desired position.

A trapezium-shaped quadrilateral opening is formed by the frame members and is bounded by the post 22, the upper cross member 32, the lower cross member 30 and the adjustable member 38. Since no two of these members are parallel, the configuration of the opening is that of a trapezium. The size of this opening can be varied in accordance with the effective service height of the user and there are two variables for this size adjustment. One variable $\Delta$ is the distance along the post 22 between the upper cross member 32 and the lower cross member 30. The other variable $X_2$ is the distance along the lower cross member 32 from the post 22 to the adjustable member. Calculations will be set forth hereinafter for solving both of these variables in accordance with the user's effective service height. However, even with these adjustments, certain aspects of the opening remain constant. The post 22 is always perpendicular to the ground and the upper cross member 32 is always parallel to the ground, and hence the member 32 and the post 22 are always in perpendicular relation to each other. Likewise, the adjustable member always forms an acute angle with the lower cross member 30 and an obtuse angle with the upper cross member 32.

A net means 46 extends at least across the trapezium-shaped opening and preferably completely across from the post 22 to the post 24 to enhance the convertible aspects of the device 20. The surface area of the net means 46 in a vertical direction is greater than the distance $\Delta$ between the cross members to assure that the net will hang loosely behind the opening to form a pocket 48 which can collect and retain tennis balls B which are hit through the opening. Small hook members 50 carried by the adjustable member 38 can be hooked to the net means 46 to close the net along the side of the quadrilateral opening bounded by the adjustable member. It is important to understand that even though an additional or auxiliary opening is formed between the post 24 and the adjustable member 38, this opening has no particular significance in terms of the invention. In fact, balls hit into this auxiliary opening would be faults on a regulation tennis court. The significant opening in this invention is the one previously described, namely, that opening bounded in FIG. 1 on the left by the adjustable member 38, on the right by the post 22 and on the top and bottom by the cross members 32 and 30, respectively. Any ball hit into this opening would be a good serve on a regulation tennis court.

The net means 46 can be connected to the frame means n any suitable fashion. If the frame members are slotted, as illustrated in FIG. 2 by the slot 52 in cross member 30, then a thickened net edging 54 can fit within the cross member while the net extends out through the slot 52. As an alternative, if the frame members are solid, as illustrated in FIG. 3, net edging 56 can be wrapped around and stitched at 58 to form a tube through which the cross member can extend. As shown in FIG. 8, lateral dividers 60 and 62 along the net means can divide the net means into discrete areas and hence separate pockets such as pockets 48*a*, 48*b* and 48*c*. This enables the user to practice serves to a particular part of the service court.

FIG. 4. illustrates the manner of calculating the effective service height for this invention. The term "serving height" or "effective service height" as used herein is intended to represent the value of *h* in FIG. 4. That value is the vertical distance from the ground to point where the ball impacts with the racket during a proper serve. This impact point on the racket is sometimes referred to as the sweet spot. Obviously, the value of *h* must vary in accordance with the server's height, arm length, racket and serve style. However, once this value is measured, all other calculations required herein can be made.

Referring now to FIG. 5, there is illustrated therein, in diagrammatic form, the trajectories which a tennis ball would follow when served from point P. This point designated P is disposed a distance h above ground level, as was discussed in connection with FIG. 4. The lowest parabolic trajectory which the ball could follow while still clearing the net is designated L. The highest parabolic trajectory which the ball could follow while still landing inside the rear service line is designated U. The linear distance from the X-axis containing point P to the end of the lower curve is designated $Y_L$ and to the end of the upper curve is designated $Y_u$. Finally, the value δ equals the distance beyond the net to the impact point of a ball travelling the lower trajectory.

Recognizing that the general equation for solving a parabolic trajectory is:

$$y^2 = aX \quad [1]$$

where $a$ is a constant coefficient. It can then be seen that in the case of the lower curve:

$$Y_L^2 = A_L X_L \quad [2]$$

At the net, $Y_L = 39$ while $X_L = h\text{-}3$. Substituting these values in equation [2] one finds that $$a_L = \frac{1521}{h-3}.$$

and that accordingly:

$$Y_L^2 = \frac{1521}{h-3}(X_L) \quad [3]$$

Similarly, in the case of the upper curve U, the formula is:

$$Y_u^2 = A_u X_u \quad [4]$$

At the rear service line $Y_u = 60$ and $X_u$, being on the ground, is $= h$. Therefore, substituting these values in equation [4] one finds that $$a_u = \frac{3600}{h}$$

and that accordingly:

$$Y_u^2 = \frac{3600}{h}(X_u) \quad [5]$$

Solving for the general case of $Y_s$ at any particular point, we know that at such point $$Y_s = Y_L = Y_U$$

and we further know that at such point Δ equals the difference between the upper and lower curves. That is, $$\Delta = X_L - X_u$$

and by substituting previous values we see that Δ thus has a value as follows:

$$\Delta = \left[-\frac{h}{3600} + \frac{(h-3)}{1521}\right] Y_s^2$$

or that:

$$\Delta = \left(\frac{77h - 400}{202{,}800}\right) Y_s^3 \quad [6]$$

It will be understood that Δ as defined in equation [6] constitutes the size of the opening in the device; that is, the distance between the top cross bar and the bottom cross bar. To find H, which is the position of the lower or bottom cross bar, we know that at any point $$H = h - X_L$$

and by substituting in equation [3] we find that $$H = h - \frac{h-3}{1521} Ys^2 \quad [7]$$

Finally, we can see that $$\delta = Y_L - 39$$

so that by substituting in equation [3] one finds that $$\delta = \sqrt{\frac{1521}{h-3}(h)} - 39$$

which equals $$\delta = 39 \left(\sqrt{\frac{h}{h-3}} - 1\right) \quad [8]$$

All of equations [1] through [8] have been derived using the assumption that the parabolic trajectory of the ball has been directly along the center line of the tennis court. Realizing that in actual play, this trajectory can vary anywhere between the center line and the outer line of the court, it then becomes necessary to consider equations for further conditions. One such condition, which is called Case I, considers that the serve lands anywhere along the rear service line. The other condition, called Case II, considers that the serve lands anywhere along the outer line. Obviously, between them these two cases mark the outer limits for a serve to be good. If the serve exceeds the boundaries of Case I, it is long and hence a fault. If the serve exceeds the boundaries of Case II, it is wide and hence a fault.

Referring now to FIG. 6, there is illustrated therein the boundary conditions for Case I and Case II. The reference point for measurements is designated Z. The measurement Y is the distance beyond the net that the ball can land while still being a good serve. Obviously, the maximum value for Y is 21 feet, the distance from the net to the rear service line. The measurement X is the lateral distance from the court centerline that a ball can land while still being a good serve. Obviously, the maximum value for X is 13.5 feet, the distance from the centerline to the outerline. The measurement $d$ is the same measurement as X taken along the rear service line. The value Ym is the minimum distance beyond the net that a ball can land, along the outer line, yet still be a good serve. Finally, $l_1$, and $l_2$ constitute the representative paths of the ball in Cases I and II, respectively.

Considering Case I first, we can see that $$(l_1)^2 = d^2 + (60)^2$$

so that:

$$l_1 = \sqrt{d^2 + 3600} \quad [9]$$

Remembering that the general equation for the parabolic trajectory is $$(l_1)^2 = A_u X_u$$

and recognizing that $Xu = h$ when the ball lands on the ground, we can see that $$A_u = \frac{(l_1)^2}{h}$$

or by substituting from equation [9] that:

$$A_u = \sqrt{\frac{d^2 + 3600}{h}} \quad [10]$$

By using similar triangles one can see that:

$$\frac{d}{60} = \frac{X}{39} \text{ or } X = \frac{39d}{60} \quad [11]$$

Using equation [11] and noting that the maximum value for $d$ in Case I is 13.5, we find that at the net:

$$X = \frac{39\ (13.5)}{60} = 8.775 \text{ feet} \quad [12]$$

Referring back to FIG. 5, we know that at the net $$\Delta = h - X_u - 3$$

Knowing from the general equation that $$X_u = \frac{l_1^2}{A_u}$$

we can see that $$\Delta = h - \frac{(l_1)^2}{A_u} - 3 \quad [13]$$

At the reference point Z, $l = 39$ and $A_u$ is solved by equation [10], wherein $d = 0$ since it has no displacement from point Z. Thus:

$$\Delta = h - \frac{(39)^2}{\frac{(0 + 3600)}{h}} - 3$$

or that $$\Delta = h \left(1 - \left(\frac{1521}{3600}\right)\right) - 3$$

which means that for Case I $$\Delta = 0.5775\ h - 3 \quad [14]$$

Turning now to Case II, which is the case where the serve lands along the outer line, we know that:

$$l_2 = \sqrt{d^2 + (39 + y)^2} \quad [15]$$

and from similar triangles we know that $$\frac{X}{39} = \frac{d}{39 + y}$$

which means that $$X = \frac{39d}{39 + y}$$

and since $d = 13.5$ in Case II, then $$X = \frac{526.5}{39 + y} \quad [16]$$

When the ball lands, $X_u = h$ so that the general parabolic trajectory formula becomes $$A_u = \frac{(L_2)^2}{h}$$

and by substituting with equation [15] we see that $$A_u = \frac{d^2 + (39 + Y)^2}{h}$$

Using the same technique for solving for Δ as was used in connection with equations [13] and [14] we find that $$\Delta = h\ (1 - \frac{1521}{(39+y)^2}) - 3 \quad [17]$$

It now becomes necessary to calculate Ym, the minimum distance by which a serve can barely clear the net because calculating this value also solves $X_{max}$, the maximum lateral displacement at the net. We start by recognizing that $$l_m = \sqrt{(39+Y_m)^2 + d_m^2}$$

and if $d_m = 13.5$, the general parabolic trajectory equation becomes $$A_u = \frac{(39 + Ym)^2 + 182.25}{h} \quad [18]$$

At the net $X_u = h-3$ so that if $$\frac{l_m^2}{A_u} = X_u = h - 3$$

then by equation [18]:

$$h - 3 = \frac{[X_m^2 + (39)^2]h}{(39 + Y_m)^2 + 182.25} \quad [19]$$

By using similar triangles we see that $$\frac{dm}{39 + Y_m} = \frac{X_m}{39}$$

which means that at the net $$X_m = \frac{39\ dm}{39+Y_m} = \frac{526.5}{39 + Y_m} \quad [20]$$

Squaring the value of $X_m$ in equation [20] and substituting the same into equation [19], we find that $$Y_m = 39 \left( \sqrt{\frac{h}{h-3}} - 1 \right) \quad [21]$$

Referring back to the equations thus far set forth herein, equation [14] sets the opening Δ for Case I and equation [17] sets the opening Δ for Case II. In other words, Δ is the height of the opening or, stated another way, the distance between the upper and lower cross bars for Case I and the distance between the adjustable member and lower cross bar for Case II.

To place the variable in terms of X rather than Y, equations [16] and [17] can be combined to find that $$\Delta = h \left(1 - \frac{X^2}{182{,}25}\right) - 3 \quad [22]$$

The telescoping bar connects to the top cross bar 8.775 feet from the center line of the court, as shown by equation [12]. To find $X_m$ where the telescoping bar connects to the bottom cross bar, we set equation [22] equal to zero, since, at that point, there is no more opening. By doing so we see that $$X_m = \sqrt{182.25 \left(1 - \frac{3}{h}\right)} \quad [23]$$

It thus is obvious that the point $X_m$ varies as a function of the value of $h$.

There are two other factors which must enter into the calculations if the device is to simulate accurately the true conditions encountered on a tennis court. One of these factors is the non-parallel nature of the net top with respect to the ground. The other of these factors is the fact that the ball has a true size and diameter and is not merely a point as was used in the preceding calculations.

Considering first the non-parallel aspect of the net top, one must recognize that the height at the center of the net is 3 feet, which height gradually increases to a maximum of 3.5 feet where the net connects with the support posts some 21 feet on either side of the court centerline. Assuming that the device of the present invention is going to be 12 feet wide, which is preferred, the added height factor $y$ on the outermost of the upright supports is calculated by noting $$\frac{0.5}{y} = \frac{21}{12}$$

which means that $$y = 0.2857 \text{ feet or } 3.43 \text{ inches} \quad [24]$$

This means that the lower cross bar connects with the inner upright support so that the cross bar top is exactly 3 feet and connects with the outer upright support so that the cross top is exactly 3 feet 3.43 inches.

Finally, considering that the tennis ball has a finite diameter of 2.5 or 0.208 feet, the calculation of Xm as derived by equation [23] must be corrected to accommodate this diameter. The manner of such correction is illustrated in FIG. 7 wherein the point $X_m$ is moved to the left by a certain distance until it reaches $X_2$ thus enlarging the opening or window sufficiently to compensate for the actual size of the ball. Looking to FIG. 7 we can see that $$\tan \theta = \frac{\Delta_1}{Xm - X_1}$$

and that $$\tan \alpha = \frac{\Delta_1}{X_2 - X_1} = \frac{.208}{X_2 - Xm}$$

which means that $$X_2 = \frac{.208\, X_1 - \Delta_1 Xm}{.208 - \Delta_1} \quad [25]$$

Since we already know from equation [12] that $X_1 = 8.775$ an from equation [14] that $\Delta_1 = 0.5775h - 3$ we can substitute these values and we find that $$X_2 = \frac{Xm\,(.5775h - 3) - 1.828}{.5775h - 3.203} \quad [26]$$

and by substituting equation [23] for the value $Xm$ we find that $$X_2 = \frac{\sqrt{182.25 \left(1 - \frac{3}{h}\right)}\,[.5775h - 3] - 1.828}{.5775\,h - 3.208} \quad [27]$$

It is now possible to solve the foregoing equations for all possible variations of $h$. To simplify setting the position of the telescoping rod, we can solve both $X_2$, which sets the distance from one upright support, and $12 - X_2$ which sets the distance from the other upright support. The values for these solutions are set forth in Table 1 hereinafter. The column headed Guide Number sets forth a particular code number correlated to each set of values. In other words, for each distance $h$, which is a measured value for each player, there is a corresponding Guide Number and for that Guide Number, there is a particular setting for the device. The values of Table 1 are as follows:

TABLE 1

| Guide | h | | $X_2$ | | | $12-X_2$ | | | Δ | | |
|---|---|---|---|---|---|---|---|---|---|---|---|
| No. | Ft. | Ins. | Ft. | Ins. | 1/32 Ins. | Ft. | Ins. | 1/32 Ins. | Ft. | Ins. | 1/32 Ins. |
| 0 | 7 | 0 | 10 | 6 | 22 | 1 | 5 | 10 | 1 | 0 | 16 |
| 1 | 7 | 1 | 10 | 7 | 4 | 1 | 4 | 28 | 1 | 1 | 3 |
| 2 | 7 | 2 | 10 | 7 | 18 | 1 | 4 | 14 | 1 | 1 | 21 |
| 3 | 7 | 3 | 10 | 7 | 31 | 1 | 4 | 1 | 1 | 2 | 8 |
| 4 | 7 | 4 | 10 | 8 | 12 | 1 | 3 | 20 | 1 | 2 | 26 |
| 5 | 7 | 5 | 10 | 8 | 25 | 1 | 3 | 7 | 1 | 3 | 13 |
| 6 | 7 | 6 | 10 | 9 | 6 | 1 | 2 | 26 | 1 | 3 | 31 |
| 7 | 7 | 7 | 10 | 9 | 19 | 1 | 2 | 13 | 1 | 4 | 18 |
| 8 | 7 | 8 | 10 | 9 | 31 | 1 | 2 | 1 | 1 | 5 | 4 |
| 9 | 7 | 9 | 10 | 10 | 11 | 1 | 1 | 21 | 1 | 5 | 23 |

TABLE 1-continued

| Guide No. | h Ft. | h Ins. | $X_2$ Ft. | $X_2$ Ins. | $X_2$ 1/32 Ins. | 12-$X_2$ Ft. | 12-$X_2$ Ins. | 12-$X_2$ 1/32 Ins. | Δ Ft. | Δ Ins. | Δ 1/32 Ins. |
|---|---|---|---|---|---|---|---|---|---|---|---|
| 10 | 7 | 10 | 10 | 10 | 22 | 1 | 1 | 10 | 1 | 6 | 9 |
| 11 | 7 | 11 | 10 | 11 | 2 | 1 | 0 | 30 | 1 | 6 | 28 |
| 12 | 8 | 0 | 10 | 11 | 13 | 1 | 0 | 19 | 1 | 7 | 14 |
| 13 | 8 | 1 | 10 | 11 | 24 | 1 | 0 | 8 | 1 | 8 | 1 |
| 14 | 8 | 2 | 11 | 0 | 3 | 0 | 11 | 29 | 1 | 8 | 19 |
| 15 | 8 | 3 | 11 | 0 | 13 | 0 | 11 | 19 | 1 | 9 | 6 |
| 16 | 8 | 4 | 11 | 0 | 23 | 0 | 11 | 9 | 1 | 9 | 24 |
| 17 | 8 | 5 | 11 | 1 | 1 | 0 | 10 | 31 | 1 | 10 | 10 |
| 18 | 8 | 6 | 11 | 1 | 11 | 0 | 10 | 21 | 1 | 10 | 29 |
| 19 | 8 | 7 | 11 | 1 | 21 | 0 | 10 | 11 | 1 | 11 | 15 |
| 20 | 8 | 8 | 11 | 1 | 30 | 0 | 10 | 2 | 2 | 0 | 2 |
| 21 | 8 | 9 | 11 | 2 | 8 | 0 | 9 | 24 | 2 | 0 | 20 |
| 22 | 8 | 10 | 11 | 2 | 17 | 0 | 9 | 15 | 2 | 1 | 7 |
| 23 | 8 | 11 | 11 | 2 | 26 | 0 | 9 | 6 | 2 | 1 | 25 |
| 24 | 9 | 0 | 11 | 3 | 2 | 0 | 8 | 30 | 2 | 2 | 12 |
| 25 | 9 | 1 | 11 | 3 | 11 | 0 | 8 | 21 | 2 | 2 | 30 |
| 26 | 9 | 2 | 11 | 3 | 19 | 0 | 8 | 13 | 2 | 3 | 17 |
| 27 | 9 | 3 | 11 | 3 | 28 | 0 | 8 | 4 | 2 | 4 | 3 |
| 28 | 9 | 4 | 11 | 4 | 4 | 0 | 7 | 28 | 2 | 4 | 22 |
| 29 | 9 | 5 | 11 | 4 | 12 | 0 | 7 | 20 | 2 | 5 | 8 |
| 30 | 9 | 6 | 11 | 4 | 19 | 0 | 7 | 13 | 2 | 5 | 27 |
| 31 | 9 | 7 | 11 | 4 | 27 | 0 | 7 | 5 | 2 | 6 | 13 |
| 32 | 9 | 8 | 11 | 5 | 3 | 0 | 6 | 29 | 2 | 6 | 32 |
| 33 | 9 | 9 | 11 | 5 | 10 | 0 | 6 | 22 | 2 | 7 | 18 |
| 34 | 9 | 10 | 11 | 5 | 17 | 0 | 6 | 15 | 2 | 8 | 5 |
| 35 | 9 | 11 11 | 5 | 24 | 0 | 6 | 8 | 2 | 8 | 23 | |
| 36 | 10 | 0 | 11 | 5 | 31 | 0 | 6 | 1 | 2 | 9 | 10 |

If desired, the Guide Numbers of Table 1 can be applied directly to the post members 22 and 24 and to the lower cross member 30. Thus, after a user of the device determine the proper value of h and hence the proper Guide Number, he can simply raise or lower the upper cross member 32 until it is aligned with that guide number along each post member. Then, he can move the clamp 42 to position the adjustable member 38 in alignment with the correct Guide Number along the lower cross member 30. After these adjustments have been completed, the opening in the device is precisely set for the user. If the ball thereafter served by the user passes through the opening, strikes the net 46 and drops into the pocket 48, that ball would have been a "good" serve, i.e., a serve which would have landed fairly in the service court on a regulation tennis court.

Obviously, the device 20 can be used to practice serves on the opposite service court simply by reversing the unit and pushing the pocket 48 through to hang on the opposite side of the lower cross member 30. If desired, the adjustable member 38 can be removed but the device is convertible even without such removal. By raising the upper cross member 32, the device can be used as a volleyball or shuttlecock game net. By dropping the upper cross member 32 to the bottom of the posts 22 and 24, the device can be used as a tennis, paddle tennis or related game net. The foregoing analysis was performed on the assumed basis that the server will be located a distance of 39 feet from the device 20, which is the same distance that the server is spaced away from the net on a regulation tennis court. However, it should be understood that the device 20 can actually be placed any desired distance away from the server. For example, if the device was to be used in a driveway which was shorter than 39 feet, such use would be entirely within the scope of this invention. The values of Δ and $X_2$ would naturally have to be changed accordingly, but the device should nevertheless be recognized as having the versatility to function at almost any reasonable distance from the server. Similarly, the spacing of approximately 12 feet between the support posts 22 and 24 can be varied as desired, so long as such spacing is adequate to assure that the correct size opening can be obtained at the distance and under the conditions of intended use of the device.

It is also possible to use various known expedients for enhancing the utility of the device of the present invention. Thus, back-up or auxiliary netting can be provided in surrounding relationship to the device for more complete coverage of an errant shot and for minimizing the time required to collect the balls which were improperly served. Legends can be provided in connection with the divided net portions of FIG. 8 to denote particular areas of the service court. Various other changes and modifications apparent to those skilled in the art can be made without departing from the spirit and scope of the invention as defined in the appended claims.

What is claimed is:

1. A tennis serve practice device which can be adjusted in accordance with a player's effective serving height to assure that the device will retain such served balls as would land within the service court of a regulation tennis court, said device comprising:

a pair of spaced apart upstanding side members; one of said side members being adapted for alignment along the center line of the tennis court;

an upper cross member extending between and connected with said side members;

a lower cross member disposed beneath said upper cross member and extending between and connected with said side members;

at least one of said cross members being adjustably connected with said side members to enable said upper and lower cross members to be relatively adjusted for varying the distance therebetween;

an adjustable member extending angularly between said upper and lower cross members;

said adjustable member being pivotally attached to said upper cross member and being adjustably attached to said lower cross member;

said one side member, said upper and lower cross members, and said adjustable member defining therebetween, a quadrilateral-shaped opening through which a properly served ball will pass;

net means connected to said one side member, said upper and lower cross members and said adjustable member, said net means having a height greater than the distance between said upper and lower cross members to thus form a tennis ball receiving and retaining pocket behind said quadrilateral-shaped opening for retaining balls passing through said opening;

said adjustable member being variable in length and forming an acute angle with said lower cross member at the lower outside corner of said quadrilateral-shaped opening;

said position of adjustable member along said lower cross member and the distance between said upper and lower cross members being variable in accordance with the player's effective service height.

2. A device as defined in claim 1 wherein said upper cross member is adjustably connected to said side members.

3. A device as defined in claim 1 wherein said adjustable member comprises a pair of telescoping rods.

4. A tennis serve practice device adjustable in calculated accordance with the effective serving height of the user, said device comprising:

adjustable frame means including:

an upper cross member;

a lower cross member;

an upright member connected to said upper and lower cross members; and an adjustable member spaced from said upright member and connected to said upper and lower cross members;

said frame means thus defining a quadrilateral-shaped opening;

net means connected to said frame means, said net means having a surface area greater than that of said opening to thus form a loose ball receiving and retaining pocket behind said opening;

at least one of said cross members being adjustably connected with said upright member to enable said upper and lower cross members to be relatively adjusted for varying the vertical distance therebetween in accordance with the formula $$\Delta = (0.5775\ h - 3)\ \text{feet}$$

where $\Delta$ = said vertical distance and h = said effective serving height;

said adjustable member being adjustably connected with said lower cross member to enable the lateral distance along said lower cross member from said upright member to said adjustable member to be adjusted in accordance with the formula $$X_2 = \frac{(.5775h - 3)\ [182.25\ (1 - 3/h)]^{0.5} - 1.828\ \text{feet}}{.5775h - 3.208}$$

where $X_2$ + said lateral distance and $h$ = said effecting serving height.

5. A device as defined in claim 4 wherein said adjustable member is variable in length.

6. A device as defined in claim 4 wherein said adjustable member is pivotally connected at its upper end to said upper cross member.

7. A tennis serve practice device which is convertible into a tennis, volleyball, shuttlecock or other game related net, said device comprising:

a pair of spaced parallel upstanding support posts mounted upon ground-engaging bases;

said posts being laterally spaced apart by a distance of substantially 12 feet;

one of said posts defined as the inner post being adapted for alignment with the centerline of a tennis court; the other of said posts being defined as the outer post;

a lower cross bar extending between said posts and connected thereto;

said lower cross bar being 3 feet above the ground where it connects to said inner post and being 3 feet 3.43 inches above the ground where it connects to said outer post;

an upper cross bar extending between said posts and being adjustably connected thereto;

said upper cross bar being parallel to the ground;

said upper cross bar being spaced above said lower cross bar by a distance along said inner post equal to $$(0.5775\ h - 3)\ \text{feet}$$

where $h$ = the effective serving height of the user of the device;

an adjustable member extending angularly between said upper and lower bars, said adjustable member being variable in length;

said adjustable member being pivotally connected at its upper end to said upper cross bar at a distance 8.775 feet from said inner post;

said adjustable member being adjustably connected at its lower end to said lower cross bar at a distance displaced from said inner post by $$\frac{(.5775h - 3)\ [182.25\ (1 - 3/h)]^{0.5} - 1.828\ \text{feet}}{.5775h - 3.208}$$

where $h$ = the effective serving height of the user of the device; and net means connected across said posts and said upper and lower cross bars, said net means also being connected to said adjustable member;

said net means having a vertical height which exceeds the vertical distance between said upper and lower cross bars to thus form a loose pocket which hangs partially beneath said lower cross bar;

said area of said pocket between said adjustable member, said inner post and said upper and lower cross bars constituting the area where properly served balls are collected.

8. A method for enabling a tennis player to accurately practice his service without actually using regulation tennis court facilities, said method comprising the steps of:

providing a upright framework means having adjustably interconnected members which define a trapezium-shaped quadrilateral opening;

positioning one of said members to define a top member, another of said members to define a bottom member, another of said members to define a straight side member and another of said members to define an angular side member which forms an obtuse angle with said top member and an acute angle with said bottom member;

measuring the effective sevice height of the tennis player, adjusting the position of said top member relative to said bottom member in calculated accordance with said measured effective service height;

adjusting the angular disposition of said angular side member with respect to said top and bottom members in calculated accordance with said measured effective service height; and positioning the framework means with the adjusted members at a predetermined distance away from the tennis player, to permit the tennis player to direct his service at the said opening.

9. A method as defined in claim 8 wherein the step of adjusting the position of the top member relative to the bottom member is done in accordance with the formula $$\Delta = (0.5775\ h - 3)\ \text{feet}$$

where $\Delta$ is the distance between the top and bottom members taken along the straight side member and $h$ is the measured effective service height.

10. A method as defined in claim 8 wherein the step of adjusting the angular disposition of said angular side member is done in accordance with the formula $$X_2 = \frac{(.5575\ h - 3)\ [182.25\ (1 - 3/h)]^{0.5} - 1.828\ \text{feet}}{.5775h - 3.208}$$

$$X_2 = \frac{(.5775h - 3)\ [182.25\ (1 - 3/h)]^{0.5} - 1.828\ \text{feet}}{.5775h - 3.208}$$

where $X_2$ is the distance along said bottom member from said straight side member to said angular side member and $h$ is the measured effective service height.

11. A tennis serve practice device comprising:

adjustable upright frame means including first, second, third, and fourth frame members adjustably interconnected and thereby forming and circumscribing a trapezium-shaped quadrilateral opening of variable configuration;

net means connected to said frame members and disposed adjacent to said opening;

said net means having a surface area greater than that of said opening to form a tennis ball receiving and retaining pocket;

said first frame member being disposed substantially perpendicular to the ground;

said second frame member being disposed substantially perpendicular to said first frame member;

said third frame member being disposed beneath said second frame member and extending from said first frame member to the lower end of said fourth frame member;

said fourth frame member being variable in length and being pivotally attached at its upper end to said second frame member and adjustably attached at its lower end to said third frame member;

said fourth frame member thus being relatively movable along said third frame member for attachment at a predetermined position therealong;

said fourth frame member forming an acute angle with said third frame member and an obtuse angle with said second frame member;

said adjustment of said frame means being in calculated accordance with the serving height of the person using said device to vary the configuration of said opening to assure that the pocket will receive and retain only those served tennis balls which would land in the proper service area of a regulation tennis court.

12. A tennis serve practice device as defined in claim 11 wherein said second frame member is adjustably attached to first frame member to thus enable the distance between said second and third frame members to be varied.

* * * * *